US005915406A

United States Patent [19]

Traylor

[11] Patent Number: 5,915,406

[45] Date of Patent: Jun. 29, 1999

[54] AIR GAP DEVICE FOR WATER SOFTENER SYSTEM

[76] Inventor: Paul L. Traylor, 19171 La Loma, Santa Ana, Calif. 92705

[21] Appl. No.: 09/023,803

[22] Filed: Feb. 13, 1998

[51] Int. Cl.[6] ..... E03C 1/10

[52] U.S. Cl. ..... 137/216; 137/216.1; 285/12; 285/331

[58] Field of Search ..... 137/216, 216.1; 285/12, 331

[56] References Cited

U.S. PATENT DOCUMENTS

| | | | |
|---|---|---|---|
| 3,158,169 | 11/1964 | Smith | 137/216 |
| 3,411,524 | 11/1968 | Raine et al. . | |
| 4,722,556 | 2/1988 | Todd | 285/12 |
| 4,856,121 | 8/1989 | Traylor . | |
| 5,176,165 | 1/1993 | Traylor . | |
| 5,305,778 | 4/1994 | Traylor . | |
| 5,592,964 | 1/1997 | Traylor . | |

FOREIGN PATENT DOCUMENTS

| | | | |
|---|---|---|---|
| 455417 | 7/1968 | Switzerland | 285/331 |

*Primary Examiner*—Gerald A. Michalsky

[57] ABSTRACT

An air gap device for a water softener system, the device having depending inner and outer skirt portions adapted to engage the inner and outer surfaces of an upstanding relatively small standard size waste standpipe, the outer skirt portion also being adapted to engage the inner surface of an upstanding relatively large standard size waste standpipe.

21 Claims, 3 Drawing Sheets

AIR GAP DEVICE FOR WATER SOFTENER SYSTEM

BACKGROUND OF THE INVENTION

1. Field of the Invention

The present invention relates to an air gap device for a water softener system, and particularly to an air gap device adapted for attachment to both relatively small and relatively large standard size waste standpipes, whether they are made of plastic or metal, or are threaded or unthreaded.

2. Description of the Prior Art

A typical household water softener continuously treats incoming water by passing it through a resin composition. Water flow through the composition is periodically interrupted so that the resin composition can be flushed with salt water to rejuvenate it. Backsiphoning of the waste water flow into the household potable water system is prevented by passing the waste flow through an air gap device prior to discharging it into the waste standpipe.

The discharge of waste from a typical household reverse osmosis system must also be directed through an air gap device to prevent backsiphoning. Although it is not mandatory, it is desirable that both the water softener and reverse osmosis waste water discharges be directed through one air gap device for simplicity of operation, reduced cost and ease of installation. Various devices are available in the prior art to accomplish this, one such device being disclosed in my U.S. Pat. No. 5,592,964. Analogous arrangements are disclosed in my U.S. Pat. No. 5,176,165, and in U.S. Pat. No. 3,411,524 issued to Robert E. Raine and to the present applicant.

The waste standpipe is usually located somewhere close to the water softener drain line but it can be located elsewhere, and in some cases extends into a wall box which is recessed into the wall for convenience.

Most standpipes are made of galvanized steel pipe or polyvinyl chloride plastic, and are typically made available in a smaller diameter standard size of one and one-half inches, and a larger diameter standard size of two inches. Of course, other materials and sizes can be used if desired, but the two mentioned are very commonly used.

Insofar as applicant is aware, there are no air gap devices in the prior art that are adapted for connection to both threaded and unthreaded metal and plastic waste standpipes of different standard sizes.

Thus, if the air gap device has a threaded end fitting for threaded connection to a threaded standpipe, it will fit only one size of standpipe. Additional air gap devices are required for each different size, presenting a stocking problem for both sellers and users.

On the other hand, if the air gap device is not threaded but has a slip fit end, it can only be connected to a threaded standpipe if it is forced onto or within the threads of the standpipe, depending upon the diameter of the standpipe. However, this would not be desirable, particularly in the absence of a generous overlap of the parts, because the air gap device could be accidentally separated from the standpipe, and also because water could leak past the threaded area of the standpipe.

If the standpipe and air gap device are both unthreaded and made of plastic, they can be permanently slip fitted together by using a suitable adhesive.

SUMMARY OF THE INVENTION

According to the present invention, an air gap device is provided which prevents backsiphoning of waste water from a water softener system and, if desired, also from a reverse osmosis (RO) potable water system. The device is preferably made of corrosion resistant, inexpensive plastic material molded in one piece for simplicity of design and economy of manufacture. It can be molded to include a threaded end fitting for threaded attachment in a vertical orientation to a threaded waste water standpipe, but preferably the end fitting is of the slip fit type. It can then be coupled to both threaded and unthreaded waste standpipes. It can also include a receptacle or opening for accepting relatively small tubing which forms the drainage for RO waste water.

Both the RO receptacle and the end fitting are adapted to include a nozzle for shaping the flow of water softener or RO waste water, as the case may be, into a well defined, vertically directed stream. This increases the system water flow capacity and reduces splattering of the water softener waste water out of the air gap device. RO tubing is preferably in coaxial alignment with the end fitting in order to best direct RO and water softener waste discharge past the opening in the air gap device.

The air gap device comprises a downwardly open body having the necessary air gap opening to comply with plumbing codes. The body also includes inner and outer depending skirt portions adapted to be biased against the inner and outer surfaces of the upper extremity of the smaller standard size waste standpipe, i.e. one and one-half inches in diameter.

In addition, the outer surface of the outer skirt portion is also adapted to be biased against the inner surface of the upper extremity of the larger standard size waste standpipe, i.e. two inches. Accordingly, the device is adapted for attachment to both standard size standpipes without any structural modification.

To facilitate a good seal, the outer skirt portion may include a plurality of circumferentially arranged slit-like openings to enable the skirt portion to be deformed or flexed inwardly and outwardly. The tendency of the skirt portion to return to its original or undeformed state causes it to exert a firm bias or seating pressure against the adjacent waste standpipe surface with which it is associated. Another important feature of the invention is that the skirt portion which is seated against the adjacent waste standpipe surface always lies within the interior of that standpipe surface, whether the standpipe is of the smaller or the larger standard size.

With the foregoing arrangement the present air gap device can be configured for quick and easy coupling, without screw threads or adhesive, to either of two standard sizes of metal or plastic waste standpipe. Whether the standpipe is made of plastic or metal, some portion of the air gap body will be firmly biased against the adjacent surface or surfaces of the waste standpipe. Because the lower portions of this unique design are always located inside the supporting standpipe, any leakage or splatter will be kept within the supporting standpipe. When a recessed wall box is used, the present air gap device easily fits within the box recess into which the standpipe is inserted or located.

Other features and advantages of the invention will become apparent from the following detailed description, taken in conjunction with the accompanying drawings which illustrate, by way of example, the features of the invention.

DESCRIPTION OF THE PREFERRED EMBODIMENTS

Figure 5:
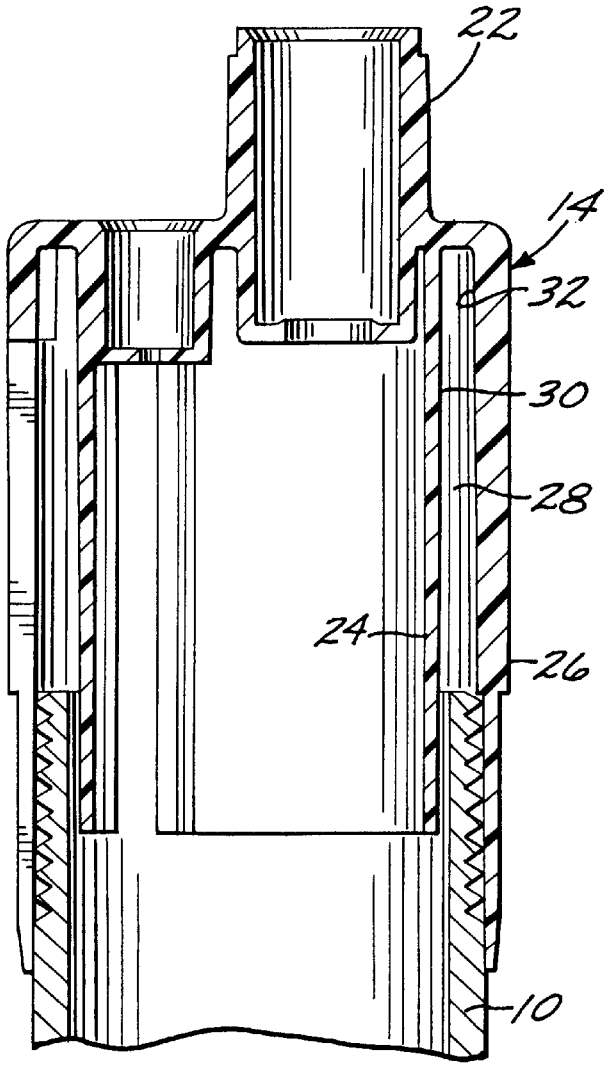
FIG. 5 is a view taken along the line 5—5 of FIG. 2, and illustrating a portion of the threaded upper extremity of a standard smaller size waste standpipe inserted within the outer skirt portion of the air gap device.
Figure 6:
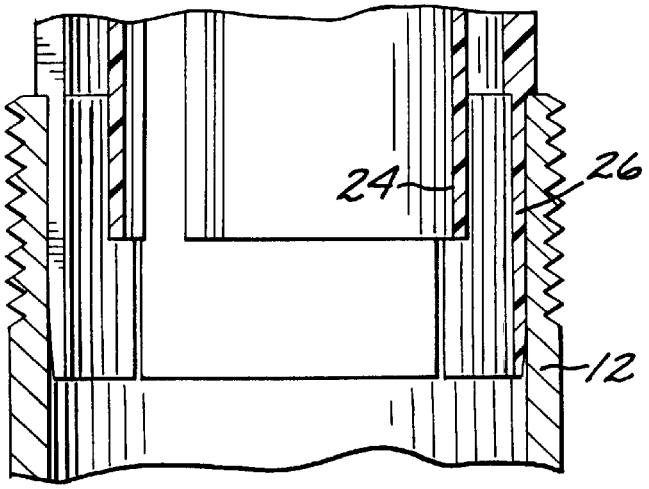
FIG. 6 is a view similar to FIG. 5, but illustrating a portion of the threaded upper extremity of a standard larger size waste standpipe engaged upon the outside of the outer skirt portion of the air gap device.

Referring now to the drawings, one embodiment of the present air gap device is illustrated as it would appear when connected to water treatment apparatus such as a water softener (not shown), a reverse osmosis potable water system (not shown), and either a smaller standard size waste standpipe 10 (as seen in FIG. 5) or a larger standard size waste standpipe 12 (as seen in FIG. 6).

The air gap device is integrally molded of a suitable plastic material in a one piece construction which includes a body 14 and a splatter shield 16 spaced from but substantially overlying an air gap opening 18 provided in the body 14. The shield 16 substantially prevents water from splattering out of the air gap opening 18 as it flows past the opening, as will be seen.

The body 14 is cylindrical and downwardly open to enable the discharge of waste water through its bottom into the associated standpipe. The body 14 includes an upper extremity or top wall 20 which includes a cylindrical, vertically oriented end fitting 22 having a suitable bore which at its base is provided with a small opening constituting a nozzle.

Figure 4:
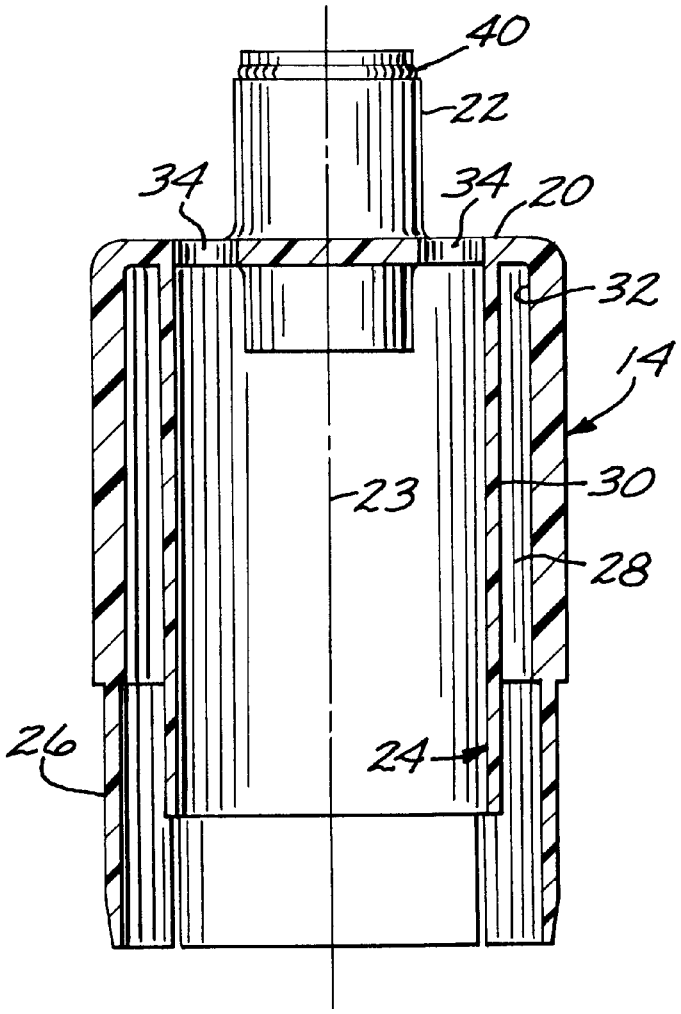
FIG. 4 is a view taken along the line 4—4 of FIG. 2.

As best seen in FIGS. 4 and 5, the bore of the end fitting 22 is preferably smooth or unthreaded so that a suitable flow straightening element, nozzle or stream modifier can be slip fitted within it. The stream modifier may be like that shown in my U.S. Pat. No. 5,592,964, comprising a plurality of radially outwardly oriented fins which define a plurality of vertical passages that promote laminar flow of the waste water through the nozzle along a vertical flow axis 23.

A water softener waste water drain line (not shown) may be attached in any suitable fashion for discharge into the end fitting 22. For this purpose, any means of connection may be used, depending upon whether the drain line is flexible or rigid, its size, etc., including slip fit with or without adhesive, compression fit, or the so-called John Guest push-in type of fitting. Alternatively, if desired, the top wall 20 could be molded to include a threaded boss to provide for threaded connections to the air gap device, or various other forms of connection may be used, as will be apparent to those skilled in the art. Frequently where commercial polyvinylchloride (PVC) slip fittings are slipped over the end fitting 22, a standard size O-ring (not shown) can be installed within a groove 40 to provide a leak tight port connection without any adhesives or the like.

The air gap body 14 includes integrally molded cylindrical inner and outer skirts 24 and 26, respectively, which are coaxial and spaced apart to define a cylindrical cavity 28. The lower edges of the skirts are preferably feathered or tapered, as best seen in FIG. 4, so that they will more easily fit over or within the associated standpipe.

The cavity 28 has confronting inner and outer surfaces 30 and 32, respectively, which are adapted to engage the inner and outer surfaces of the upper extremity of the small standard size waste standpipe 10, as seen in FIG. 5. It also is preferably characterized by different diameters to form a collar or flange for engagement by the end of the standpipe 10.

The outer surface of the outer skirt 26 is also adapted to engage the inner surface of the upper extremity of a relatively large standard size waste standpipe 12, as seen in FIG. 6, so that the air gap device is immediately capable of association with either a standard one and one-half inch standpipe, or a standard two inch standpipe without need for any adjustment or modification. This arrangement also minimizes water leakage at the joints where the skirts engage the standpipes, the inner skirt 24 extending into the standpipe 10, as seen in FIG. 5, and the outer skirt 26 fitting within the standpipe 12 in the arrangement of FIG. 6.

The generally rectangular air gap opening 18 is made at least one inch in height to satisfy plumbing codes, and extends through both the inner and outer skirts 24 and 26 to provide an unobstructed venting passage into the interior of the body 14. Additional openings 34 are made in the top wall 20 to provide additional venting passages and thereby further insure against backsiphoning. The openings can also be used for visual inspection.

The water splatter shield 16 and skirt 34 are integrally molded as part of the top wall 20. Shield 16 extends downwardly, and partially overlies the air gap opening 18 to reduce splattering of water out of the opening. Preferably its vertical free edges are inwardly directed at 42 to maximize the capture of errant water droplets. As will be apparent, use of a nozzle and a laminar flow stream modifier (not shown) in the fitting 22 will further reduce such splattering.

Splattering is further reduced by a pair of vertically extending small projections 41 extending along and integral with the skirt 34 along its entire length.

Figure 1:
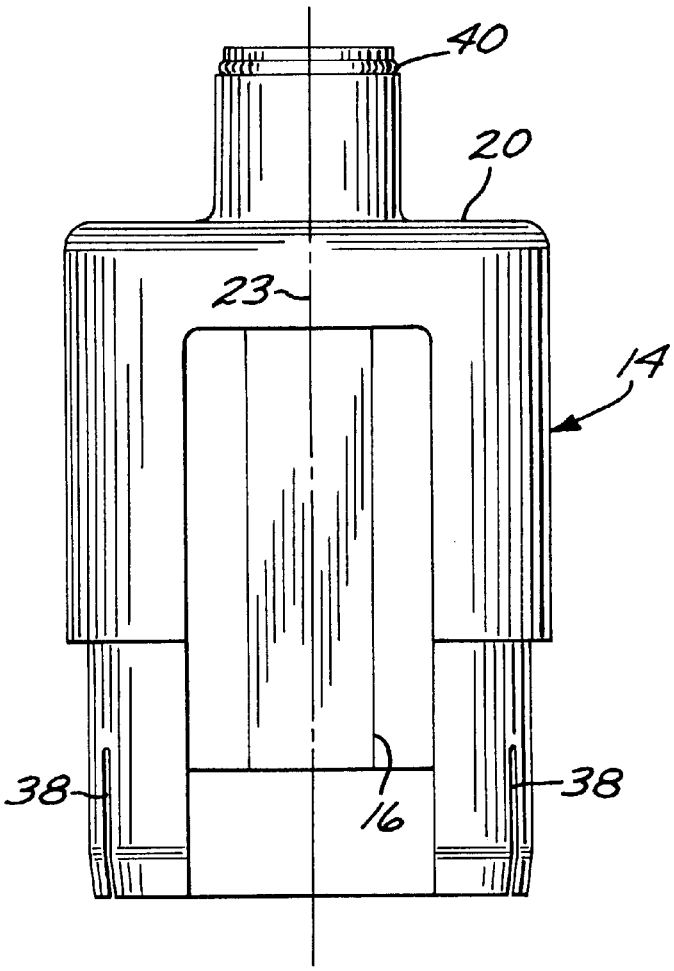
FIG. 1 is side elevational view of the air gap device in its normal vertical mounting position.
Figure 2:
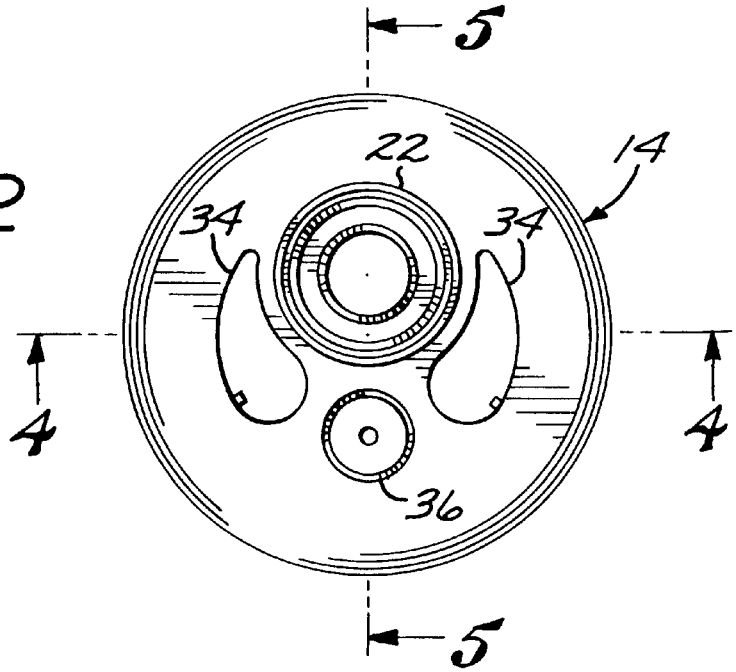
FIG. 2 is a top view of the air gap device.
Figure 3:
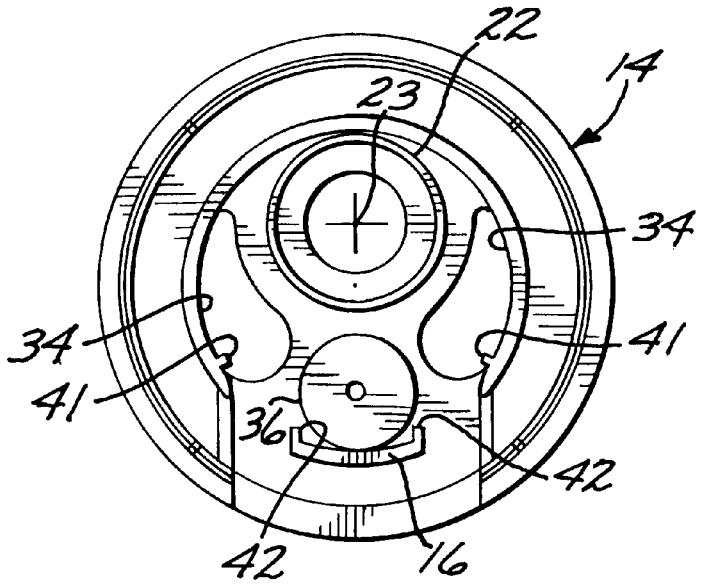
FIG. 3 is a bottom view of the air gap device.

As best seen in FIGS. 2 and 3, a feature of the air gap device is that it provides venting and back siphonage protection not only for a water softener system, but also for a reverse osmosis system. For this purpose the top wall 20 includes an opening 36 into which usual three eighths inch flexible tubing extending from the waste port of the reverse osmosis system can be press fitted. Such a press fitted connection has been found to be adequate under the relatively low pressure conditions present in the RO drain system.

The opening 36 is formed and arranged to mount the flexible RO tubing in a vertical orientation, and, as illustrated, with its vertical axis arranged parallel to the vertical axis of the usual soft water waste discharge tubing which is connected to the end fitting 22. This vertical orientation aligns the RO water flow with the water softener flow and reduces turbulence and promotes laminar flow, compared to a laterally oriented RO drain line. Although not shown, the fitting 22 can also be molded so that it mounts on the associated standpipe at a very slight tilt, no more than a few degrees from vertical, so that the centerlines of the RO and soft water waste flow paths tilt slightly away from the air gap opening 18. This further minimizes water splattering out of the opening 18.

It has been found that a more reliable, relatively rigid mounting of the air gap body 14 onto the associated standpipe is provided by configuring and dimensioning the skirt portion 26 so that it is biased or pressed against the standpipe. This is promoted by providing the lower section of the skirt portion 26 with a plurality of circumferentially arranged slit-like openings 38. These permit the skirt portion 26 to bend or flex inwardly and outwardly. When properly dimensioned in relation to the size of the associated standpipe, the skirt portion develops an inward bias upon the outer surface of a smaller size standard standpipe 10 when it is forced over the standpipe or, in the case of a larger size standpipe 12, the skirt portion develops an outward bias when it is forced within the standpipe 12. Although not shown, the skirt portion 26 can also be modified "on the job" to provide a cut-out portion in the skirt portion 26, between adjacent slits 38, to accommodate any obstructions in the upper extremity of the standpipe, such as a weld bead.

From the foregoing it can be seen that the present air gap device provides for universal attachment to the two most widely used standard sizes of standpipe, whether the standpipe is made of plastic or metal, and whether the standpipe is threaded or unthreaded.

While several forms of the invention have been illustrated and described, it will be apparent that various modifications can be made without departing from the spirit and scope of the invention.

What is claimed is:

1. An air gap device comprising:

a downwardly open body having a generally vertical flow axis and an upper extremity which includes a substantially vertically oriented fitting having a vertical axis and adapted for directing water from a water softener line into the body along the vertical flow axis, the body further having depending outer and inner skirt portions which are spaced apart to define a cavity having confronting inner surfaces adapted to engage the inner and outer surfaces of the upper extremity of a relatively small standard size waste standpipe; the outer skirt portion including an outer surface adapted to engage the inner surface of the upper extremity of a relatively large standard size waste standpipe; the body further including an air gap having side edges and opening into the interior of the body, and a shield spaced from and partially overlying the air gap opening to reduce water splattering out of the air gap opening.

2. An air gap device according to claim 1 wherein the fitting comprises a nozzle operative to shape the flow of water from the water softener drain into a well defined stream for reducing water splattering through the air gap opening.

3. An air gap device according to claim 2 wherein the nozzle includes a vertical axis arranged parallel to the vertical flow axis of the body.

4. An air gap device according to claim 1 wherein the upper extremity, the outer and inner skirt portions and the shield are integrally molded in one piece.

5. An air gap device according to claim 1 wherein the upper extremity of the fitting is adapted to accept an O-ring to provide a water tight fit with the water softener line.

6. An air gap device according to claim 1 wherein the upper extremity of the body is defined by a top wall which includes an opening having a vertical axis adapted to mount a tube in a substantially vertical orientation for discharging reverse osmosis waste water into the body along with water from the water softener line.

7. An air gap device according to claim 6 wherein the top wall also includes supplemental vent openings into the body.

8. An air gap device according to claim 7 wherein the supplemental vent openings are dimensioned to enable visual inspection of the interior of the body.

9. An air gap device according to claim 6 wherein the vertical axis of the opening for the tube is in axial alignment with the vertical flow axis of the fitting of the body.

10. An air gap device according to claim 6 wherein the vertical flow axis of the fitting of the body is located farther from the shield than is the vertical axis of the opening for the tube.

11. An air gap device according to claim 1 wherein the outer skirt portion includes vertically oriented, circumferentially spaced apart slits to facilitate fitting of the outer skirt portion upon a standpipe.

12. An air gap device according to claim 1 wherein the side edge portions of the shield include vertically oriented, radially inwardly directed projections to form downward flow paths for water droplets.

13. An air gap device according to claim 1 wherein the side edge portions of the inner skirt portion are located adjacent the side edges of the air gap and include vertically oriented, radially inwardly directed projections to form downward flow paths for water droplets.

14. An air gap device for coupling to a water softener drain line, the device being adapted for vertical universal mounting to one of a pair of standard size waste standpipes, the device comprising;

a downwardly open body having a generally vertical flow axis and a top wall which mounts a vertically oriented nozzle for directing water from a water softener line into the body along the vertical flow axis, the body further having an upper outer portion having a first diameter, and depending outer and inner skirt portions which are spaced apart to define a cavity having confronting inner surfaces adapted to engage the inner and outer surfaces of the upper extremity of a relatively smaller standard size waste standpipe, the upper extremity of the cavity being adapted to engage the upper end of the smaller standard size waste standpipe; the outer skirt portion including an outer surface having an outer diameter less than the first diameter to thereby form a flange adapted to engage the upper end of the larger standard size waste standpipe; the body further including an air gap opening into the interior of the body, a shield spaced from and partially overlying the air gap opening to reduce water spattering from the vertically oriented nozzle out of the air gap opening.

15. An air gap device according to claim 14 wherein the nozzle is operative to shape the flow of water from the water softener drain into a well defined stream for reducing water splattering through the air gap opening.

16. An air gap device according to claim 14 wherein the top wall, the outer and inner skirt portions and the shield are integrally molded in one piece.

17. An air gap device according to claim 14 wherein the top wall includes an opening adapted to mount a tube along a vertical axis for discharging reverse osmosis waste water into the body along with water from the water softener line.

18. An air gap device according to claim 17 wherein the vertical axis of the tube is arranged parallel to the vertical flow axis of the body.

19. An air gap device according to claim 14 wherein the top wall also includes supplemental vent openings into the body.

20. An air gap device according to claim 14 wherein the nozzle includes a vertical axis arranged parallel to the vertical flow axis of the body.

21. An air gap device according to claim 14 wherein the outer skirt portion includes a plurality of circumferentially spaced apart slit-like openings enabling the outer skirt portion to flex inwardly and outwardly whereby the outer skirt portion is adapted to develop an inward bias upon the outer surface of the upper extremity of the relatively smaller standard size waste standpipe, and an outward bias upon the inner surface of the upper extremity of the larger standard size waste standpipe.

* * * * *